US005945887A

United States Patent [19]

Makino et al.

[11] Patent Number: 5,945,887

[45] Date of Patent: Aug. 31, 1999

[54] NONRECIPROCAL CIRCUIT DEVICE AND COMPOSITE ELECTRONIC COMPONENT

[75] Inventors: Toshihiro Makino, Matto; Akihito Masuda; Takashi Kawanami, both of Ishikawa-ken; Yoshihiko Ashida, Nagaokakyo, all of Japan

[73] Assignee: Murata Manufacturing Co., Ltd., Japan

[21] Appl. No.: 09/045,073

[22] Filed: Mar. 20, 1998

[30] Foreign Application Priority Data

Mar. 21, 1997 [JP] Japan ..... 9-068217
Feb. 16, 1998 [JP] Japan ..... 10-033005

[51] Int. Cl.[6] ..... H01P 1/383; H01P 1/36

[52] U.S. Cl. ..... 333/1.1; 333/24.2

[58] Field of Search ..... 333/1.1, 24.2

[56] References Cited

U.S. PATENT DOCUMENTS 3,676,803 7/1972 Simmons ..... 333/1.1
3,820,041 6/1974 Gewartowski et al. ..... 333/1.1
3,836,874 9/1974 Maeda et al. ..... 333/1.1
3,890,582 6/1975 Jeong ..... 333/1.1 X
4,724,399 2/1988 Akinaga ..... 333/1.1 X

FOREIGN PATENT DOCUMENTS 2671912 7/1992 France ..... 333/1.1
56-24815 3/1981 Japan ..... 333/1.1

*Primary Examiner*—Paul Gensler
*Attorney, Agent, or Firm*—Ostrolenk, Faber, Gerb & Soffen, LLP

[57] ABSTRACT

A nonreciprocal circuit device that avoids the problems of increased loss and narrowed frequency bandwidth when used with a low power supply voltage. An isolator (nonreciprocal circuit device) has a plurality of center electrodes (2 through 4) disposed so as to intersect and having a ferrite (5) disposed in alignment with the point of intersection, to which a DC magnetic field HDC is applied. An impedance conversion circuit (6) is added to the port of any one of center electrodes (2 through 4), setting the input impedance Zi to 2<Zi<12.5 ohms.

10 Claims, 8 Drawing Sheets

NONRECIPROCAL CIRCUIT DEVICE AND COMPOSITE ELECTRONIC COMPONENT

BACKGROUND OF THE INVENTION

1. Field of the Invention

The present invention relates to a nonreciprocal circuit device, such as a lumped-constant isolator or circulator, for use in the microwave band.

2. Description of the Related Art

Recently there has been a trend in the field of mobile communications or portable telephony toward the use of equipment using digital modulation techniques such as ¼-pi QPSK or CDMA, which provide more efficient use of bandwidth. As shown in FIG. 9, such digital communications equipment uses a linear power amplifier 20 as the transmitting power amplifier. This has a structure in which an input matching circuit 21, a first-stage amplifier 22, an interstage matching circuit 23, a second-stage amplifier 24 and an output matching circuit 25 are arranged and connected.

When a linear amplifier 20 of this type is used, the power consumption of the power amplifier has a major effect on the length of the talk-time of a battery-operated portable telephone set. Thus, a reduction in power consumption can make a dramatic improvement in efficiency.

It is, however, a characteristic of the above-described high-efficiency linear amplifiers that they are highly subject to changes in load impedance. That is to say, high-efficiency amplification is achieved only when load impedance is constant at a desirable value. For example, when a load, such as an antenna, is directly connected to a linear amplifier as described above, and its input impedance undergoes major changes, problems of decreasing amplification efficiency and degradation of input/output linearity occur. This may result in an increase in the power consumption of the transmitting power amplifier, thereby draining the battery and reducing talk-time, or in distortion of the transmission signal, thereby producing interference in adjacent channels or on adjacent frequencies. There is even the danger that modulation distortion could prevent modulation at the receiving set, rendering transmission impossible.

To overcome this problem, a lumped-constant isolator 27 may be inserted between linear amplifier 20 and antenna 26. This isolator has a structure, as shown in FIG. 8, having three center electrodes 30 through 32 disposed so as to intersect each other with given intervals therebetween, and having a ferrite 33 disposed in alignment with the point of intersection, a DC magnetic field HDC being applied, and terminal resistor R being connected to port P3 of center electrode 32.

Since the input impedance of isolator 27 is stable irrespective of changes in load impedance, it has the function of absorbing reflected energy from the antenna, thereby improving the matched state. By this means, decreases in the efficiency of the linear amplifier and degradation of input/output linearity are prevented.

Further, the input/output impedance of linear amplifier 20 is generally set at 50 ohms and the input impedance of isolator 27 is also generally set at 50 ohms, and this constitutes a standard for radio-frequency components.

On the other hand, with decreases in the size and weight of such portable telephone sets has come progress in simplifying the structure of batteries, so that in some cases voltages are now set in the vicinity of 3.6 to 6 V. In order to allow the linear amplifier to continue operating if the battery voltage falls below 3.6 V, for example, the power supply voltage of the linear amplifier may be set at approximately 3.0 V.

Furthermore, the saturation power (that is to say the power at which an increase in input produces no further increase in output) of such linear amplifiers is determined by the power supply voltage and the output impedance of the amplifier device (transistor, field-effect transistor, or more recently GaAs FET). Thus in order to obtain some margin in terms of saturation power, it is usual for the saturation power of a linear amplifier with a rated output power of, say, 1 W, to be set at 2 W or thereabouts.

It should be noted, however, that as shown in FIG. 9, at such a low power supply voltage, the output impedance Zo of output amplifier 24 will be 2 to 6 ohms, far lower than the output impedance of a linear amplifier set at the usual value of 50 ohms. To convert such a low impedance to 50 ohms, it is necessary to provide an output matching circuit 25 having a large impedance conversion ratio, but this brings about an increase in losses in the conversion circuitry and a narrowing of the frequency range within which satisfactory matching can be attained. This results in the problem of degradation in the efficiency of the power amplifier and in the operating frequency bandwidth.

SUMMARY OF THE INVENTION

Accordingly, the present invention is directed toward providing nonreciprocal circuit devices and composite electronic components that avoid increased losses and narrowed frequency bandwidth when used at a low power supply voltage, and are thereby lower in size and price.

More specifically, the invention is directed toward providing an improved nonreciprocal circuit device, such as an isolator, with improved impedance matching between the nonreciprocal circuit device and a linear amplifier, for example.

According to one aspect of the invention, a nonreciprocal circuit device has a plurality of center electrodes disposed so as to intersect and having a ferrite disposed adjacent to the point of intersection, to which is applied a DC magnetic field, wherein the input/output impedance Zio of the port of one of the center electrodes is set at $2<Zio<12.5$ ohms.

Preferably an impedance conversion circuit is added to the port of one of the center electrodes to set the input impedance Zi of the port at $2<Zi<12.5$ ohms.

To form an isolator, a terminal resistor is connected to one of the remaining ports to which the impedance conversion circuit is not added.

The impedance conversion circuit may be configured as a C-L-C pi-type network. The cut-off frequency fc of the C-L-C pi-type network may be set at $0.75\times fo<fc<2\times fo$, wherein fo is the center frequency.

The impedance conversion circuit may also be configured as an L-C-L pi-type network.

Further, the impedance conversion circuit may be configured as a (2n−1) lambda-g/4 distributed-constant transformer (where n is a natural number and lambda-g is the wavelength of the line).

According to a further aspect of the invention, the plurality of center electrodes may be so disposed as to intersect within a yoke constituting a magnetic circuit, having a magnetic assembly including a ferrite disposed adjacent to the point of intersection, and containing matching capacitors connected to the ports of the center electrodes, wherein an impedance conversion circuit is added to the port of one of the center electrodes and integrally incorporated within the yoke, so that the input impedance Zi of the port is set at 2<Zi<12.5 ohms. In this construction, the impedance conversion circuit may be formed within a structural component of the nonreciprocal circuit disposed within the yoke.

According to another aspect of the invention, a composite electronic component comprises a nonreciprocal circuit device as described above for being connected to the output of a transmitting amplifier, which is accommodated within a single case, provided with terminals for surface mounting, and operates at a power supply voltage of 6 V or less.

In the above summary of the invention, input impedance signifies the characteristic impedance of a port that is normally expected to have the function of receiving electric power, such as the input port of an isolator, output impedance Zo signifies the characteristic impedance of a port that is normally expected to have the function of sending out electric power, such as the output port of an amplifier, and input/output impedance Zio signifies the characteristic impedance of a port that is normally expected to have the functions of both receiving and sending out electric power, such as the input/output port of a circulator.

Other features and advantages of the invention will be appreciated from the following detailed description of embodiments of the present invention, based on the accompanying drawings, in which like symbols and references indicate like elements and parts throughout the disclosed embodiments of the invention.

DESCRIPTION OF EMBODIMENTS OF THE INVENTION

Figure 1:
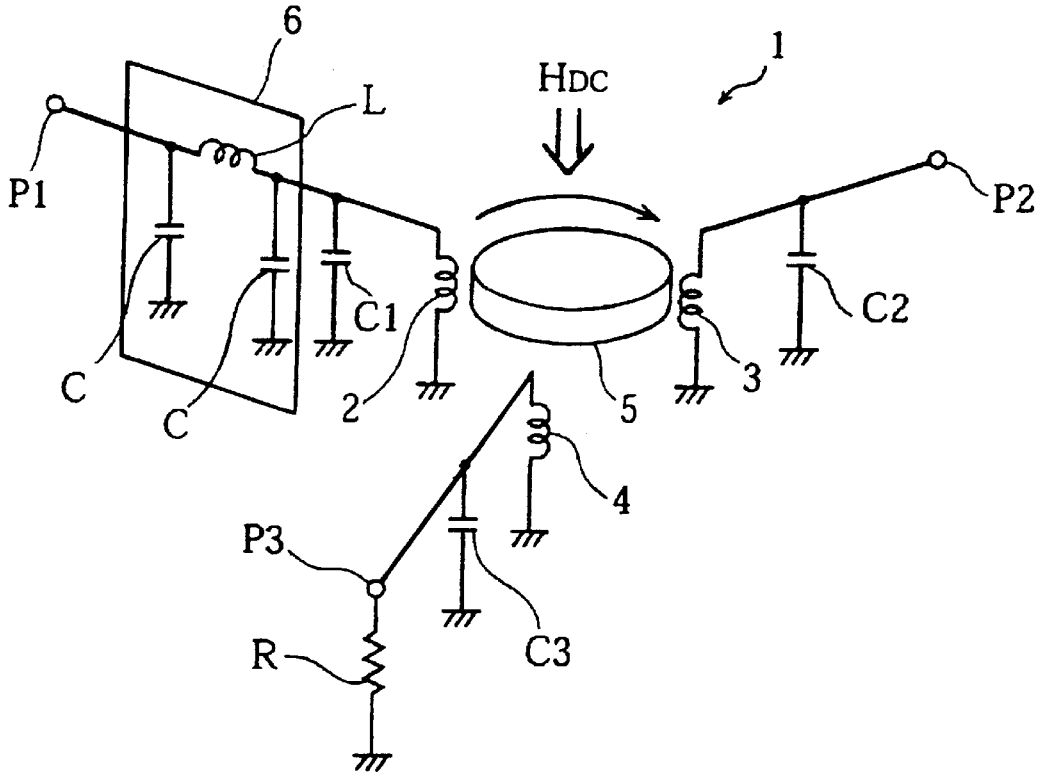
FIG. 1 is an equivalent circuit diagram of a lumped-constant isolator according to a first embodiment of the invention.
Figure 2:
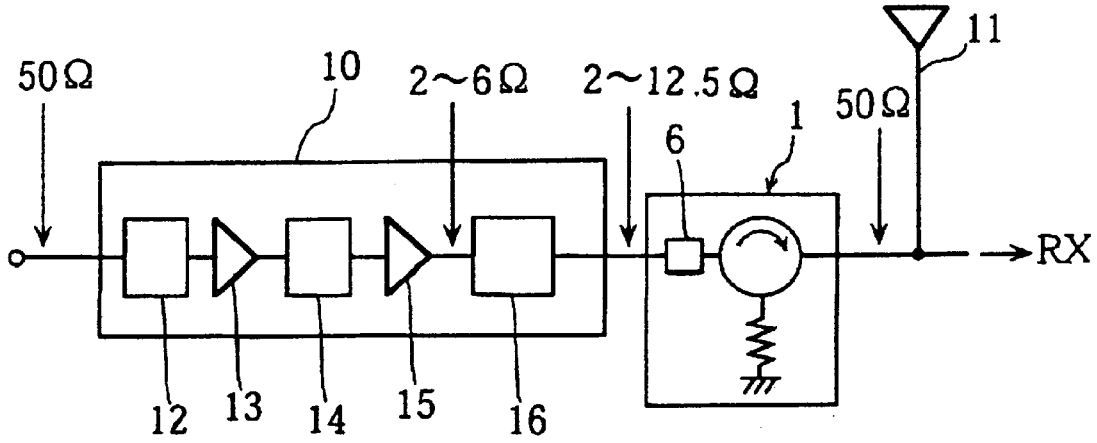
FIG. 2 is a schematic block diagram of a transmitting power amplifier containing the isolator of FIG. 1.

FIGS. 1 and 2 are drawings for the purpose of explaining an isolator according to a first embodiment of the invention. FIG. 1 is an equivalent circuit diagram of the isolator and FIG. 2 is a schematic block diagram of a transmitting power amplifier for a portable telephone set in which the isolator of FIG. 1 is used.

Lumped-constant isolator 1 of this embodiment has a structure wherein three grounded center electrodes 2, 3 and 4 are so disposed as to intersect at a given angle while being electrically isolated from each other and a ferrite 5 is disposed in alignment with their point of intersection, and a DC magnetic field HDC is applied by means of a permanent magnet (not shown). The ungrounded ends of center electrodes 2, 3 and 4 are connected, respectively, to ports P1, P2 and P3.

Matching capacitors C1 through C3 are connected in parallel with center electrodes 2 through 4, respectively, between ports P1 through P3 and ground. Terminal resistor R is connected between port P3 and ground. In this way an isolator is formed, wherein a transmission signal received at port P1 is sent to port P2, and reflected signals entering from port P2 are sent to P3 and absorbed by terminal resistor R.

Port P1 is further provided with an impedance conversion circuit 6, by means of which the impedance of only port P1 is set at 2 to 12.5 ohms, while the impedance of port P2 is set at 50 ohms. Impedance conversion circuit 6 is integrally incorporated within isolator 1, as will be discussed in more detail below.

Impedance conversion circuit 6 comprises a C-L-C pi-type network formed of an inductance L and capacitors C, and the cutoff frequency fc of the pi-type network is set in the range of $0.75 \times fo < fc < 2 \times fo$, wherein fo is the center frequency.

As shown in FIG. 2, isolator 1 is inserted between transmitting power amplifier 10 and antenna 11. Power amplifier 10 is provided with an input matching circuit 12, a first-stage amplifier device 13, an inter-stage matching circuit 14, a second-stage amplifier device 15 and an output matching circuit 16, the output of which is connected to isolator 1.

Following is an explanation of the operation of the present embodiment.

In isolator 1 of the present embodiment an impedance conversion circuit 6 is added to port P1, to which the transmitted signal is input, and the impedance is set at 2 to 12.5 ohms, thereby making it possible to convert the low output impedance of the second-stage amplifier device 15 (2 to 6 ohms) into a stable impedance.

This eliminates the need to provide a matching circuit of large impedance conversion ratio as described above, and makes it possible to use an output matching circuit 16 with an output impedance of 2 to 12.5 ohms, and which removes the reactance component only. This make it possible to reduce the insertion loss of the output matching circuit 16 when the power supply voltage is low (3 to 6 V), as well as to broaden the frequency bandwidth and improve reliability. This in turn contributes to reducing the size and weight of the portable telephone set.

In this embodiment the cutoff frequency fc of impedance conversion circuit 6 is set in the range $0.75 \times fo < fc < 2 \times fo$, so that it functions as a low-pass filter, thereby suppressing and eliminating the spurious radio waves generated by transmitting power amplifier 10, and in this way also, contributing to improved reliability and higher performance.

Figure 3:
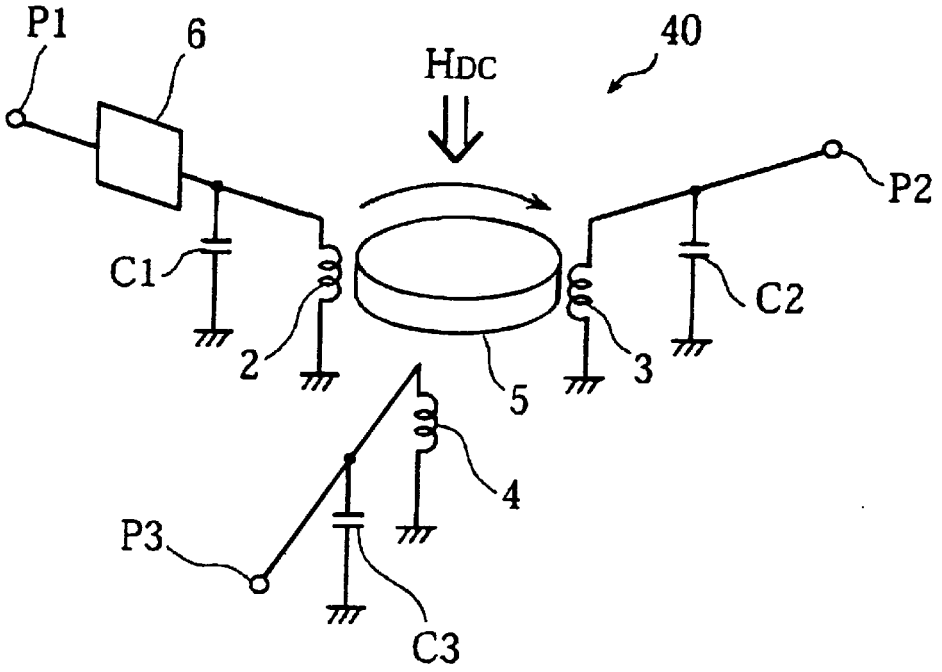
FIG. 3 is an equivalent circuit diagram of a circulator according to a second embodiment of the invention.

Note that while, in the embodiment described above, a lumped-constant isolator is used as an example, it is also possible, as shown in FIG. 3, to practice the present invention using a 3-port circulator 40. In this second embodiment, an effect similar to that of the above-described embodiment may be obtained by adding impedance conversion circuit 6 to the port P1.

Figure 4:
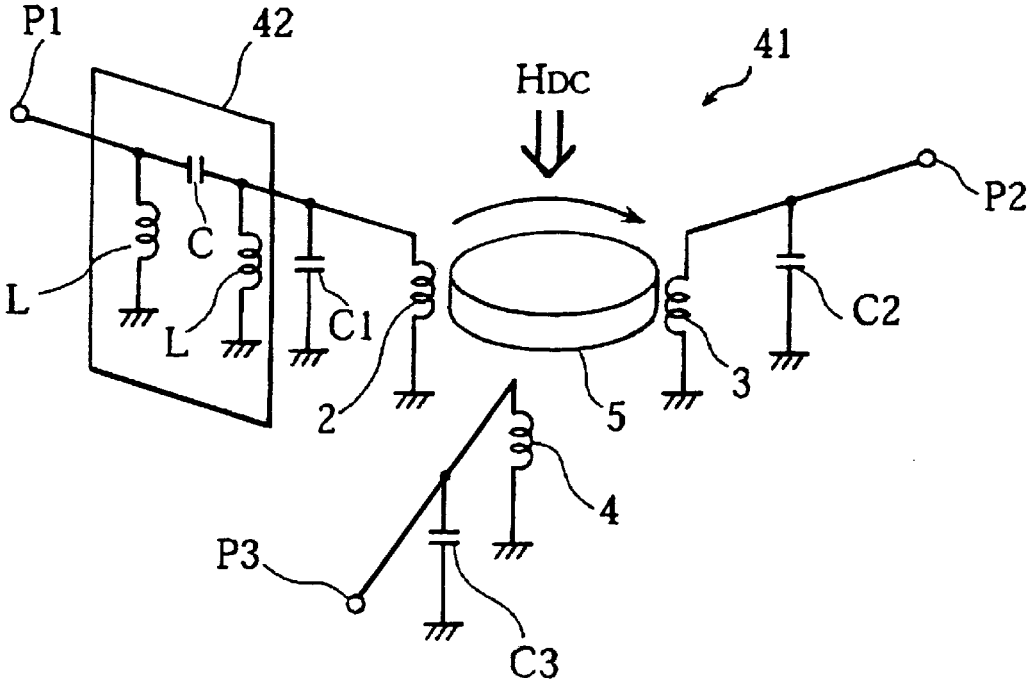
FIG. 4 is an equivalent circuit diagram of a lumped-constant isolator according to a third embodiment of the invention.

FIG. 4 is an equivalent circuit diagram for the purpose of describing a circulator according to a third embodiment of the present invention, wherein symbols identical to those in FIG. 1 designate identical or equivalent elements.

Lumped-constant circulator 41 of this embodiment has a structure wherein ferrite 5 is disposed in alignment with the point of intersection of three center electrodes 2, 3 and 4 so that a DC magnetic field HDC is applied. Impedance conversion circuit 42 is then added to one of the ports P1 of circulator 41. The impedance conversion circuit 42 has the form of an L-C-L pi-type network.

In this embodiment too, a low impedance can be converted into a stable impedance, and an effect similar to that of the above-described embodiment can be obtained.

Figure 5:
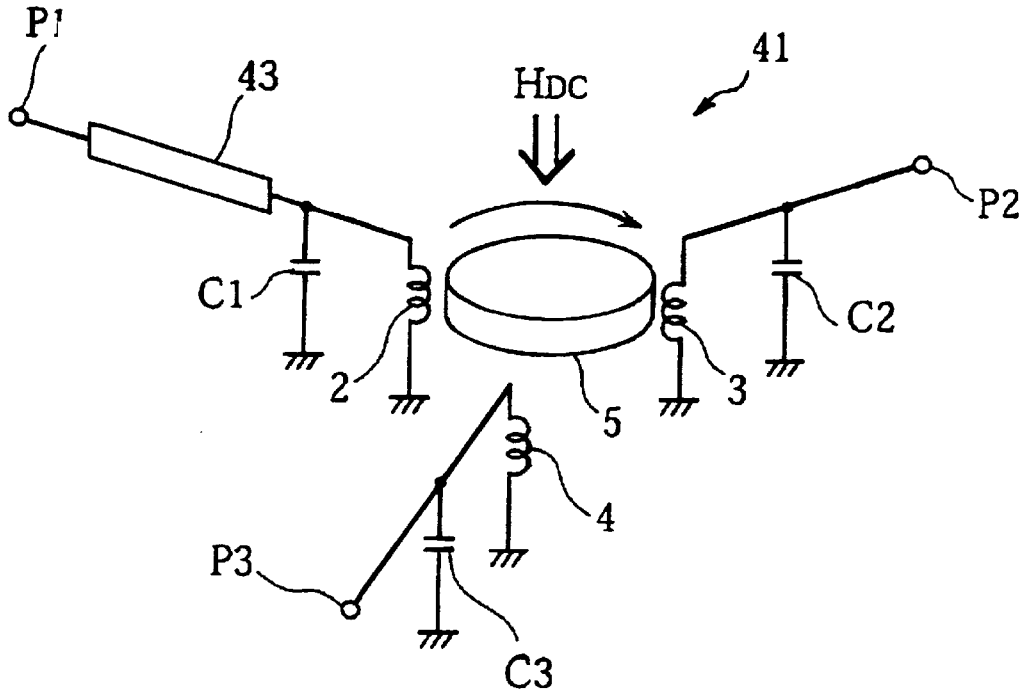
FIG. 5 is an equivalent circuit diagram of a lumped-constant isolator according to a fourth embodiment of the invention.

FIG. 5 is an equivalent circuit diagram for the purpose of describing a circulator according to a fourth embodiment of the present invention, and symbols identical to those in FIG. 1 designate identical or equivalent elements.

Circulator 41 in this embodiment represents a case in which the impedance conversion circuit 43 which is added to one of the ports P1 comprises a (2n−1)·lambda-g/4 distributed constant transformer. In this embodiment too, an effect similar to that of the above-described embodiment can be obtained.

Figure 6:
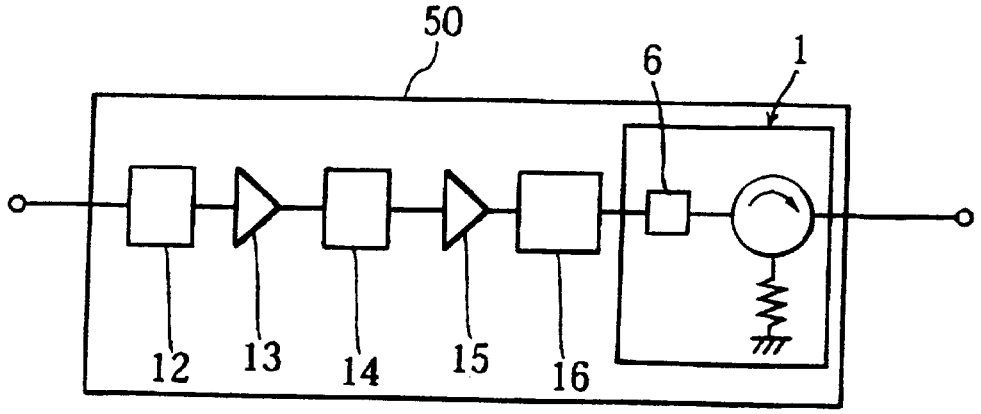
FIG. 6 is a schematic block diagram of a transmitting power amplifier in the form of a composite electronic component containing an isolator according to a fifth embodiment of the invention.
Figure 7:
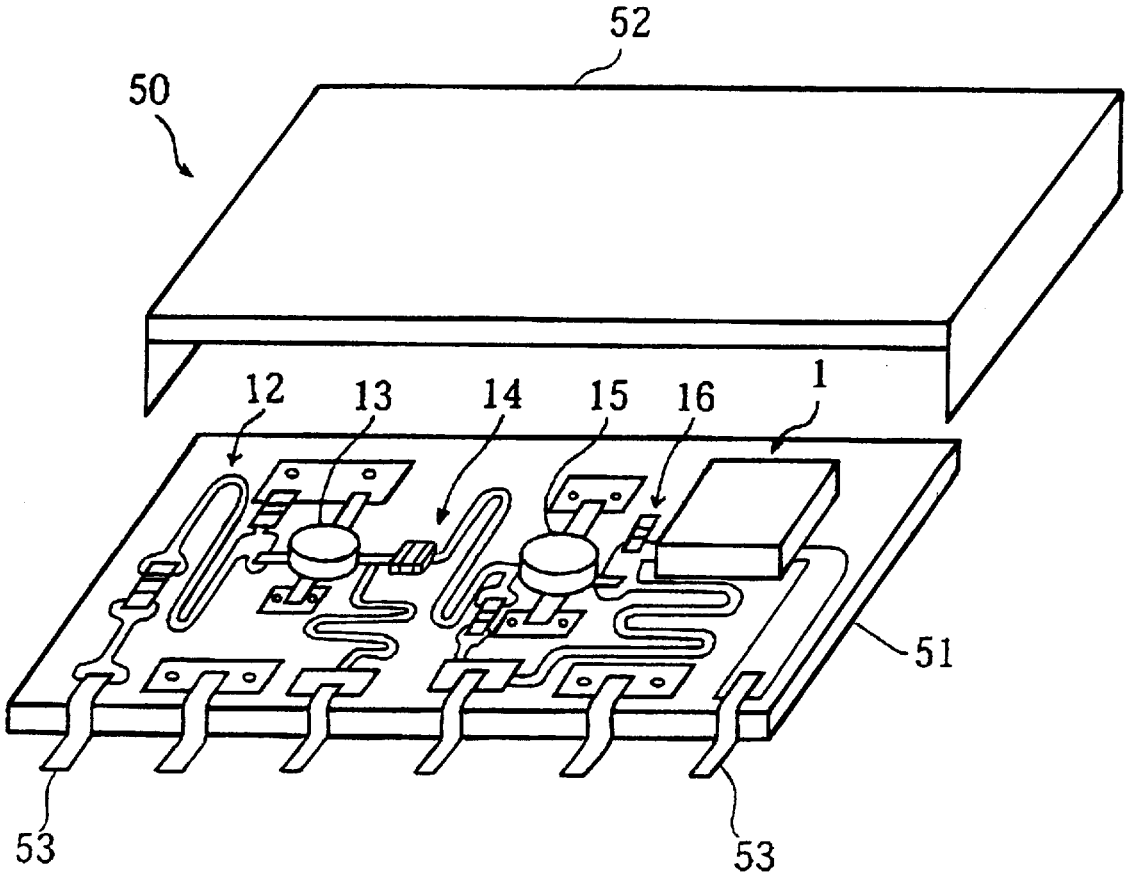
FIG. 7 is a partly exploded perspective drawing of the transmitting power amplifier of FIG. 6.
Figure 8:
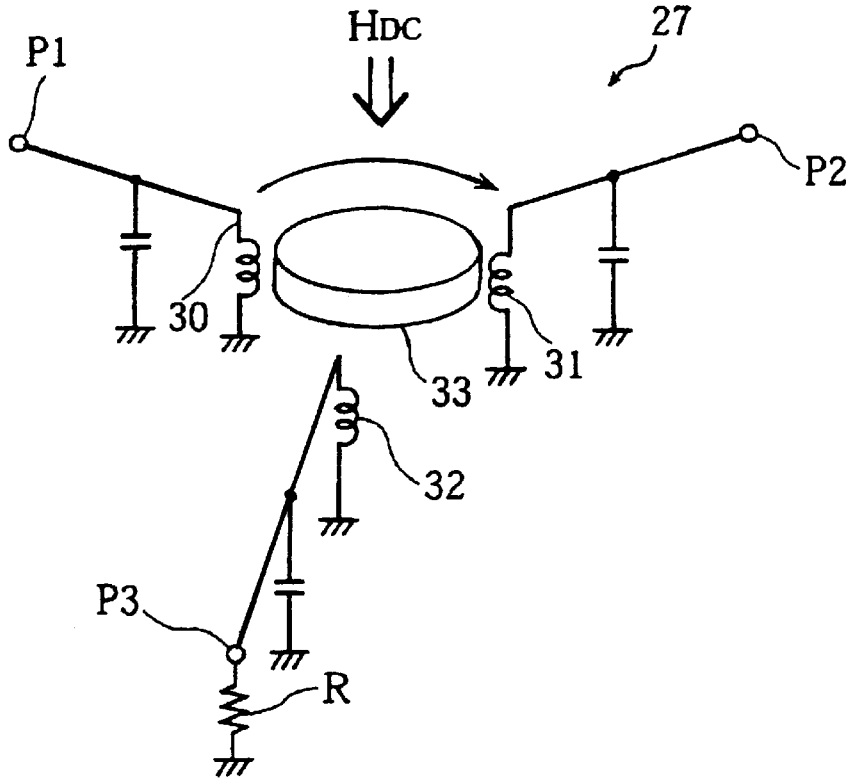
FIG. 8 PRIOR ART
FIG. 8 is an equivalent circuit diagram of a conventional isolator.
Figure 9:
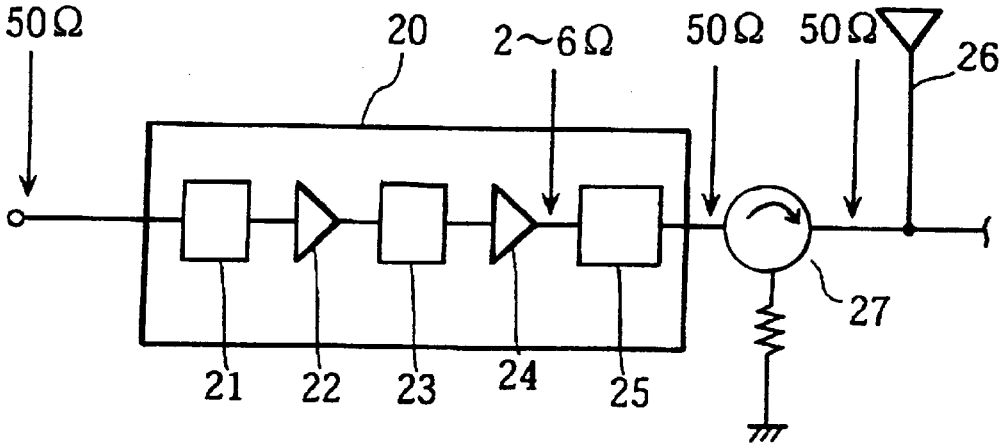
FIG. 9 PRIOR ART
FIG. 9 is a schematic block diagram of a conventional transmitting power amplifier.
Figure 10:
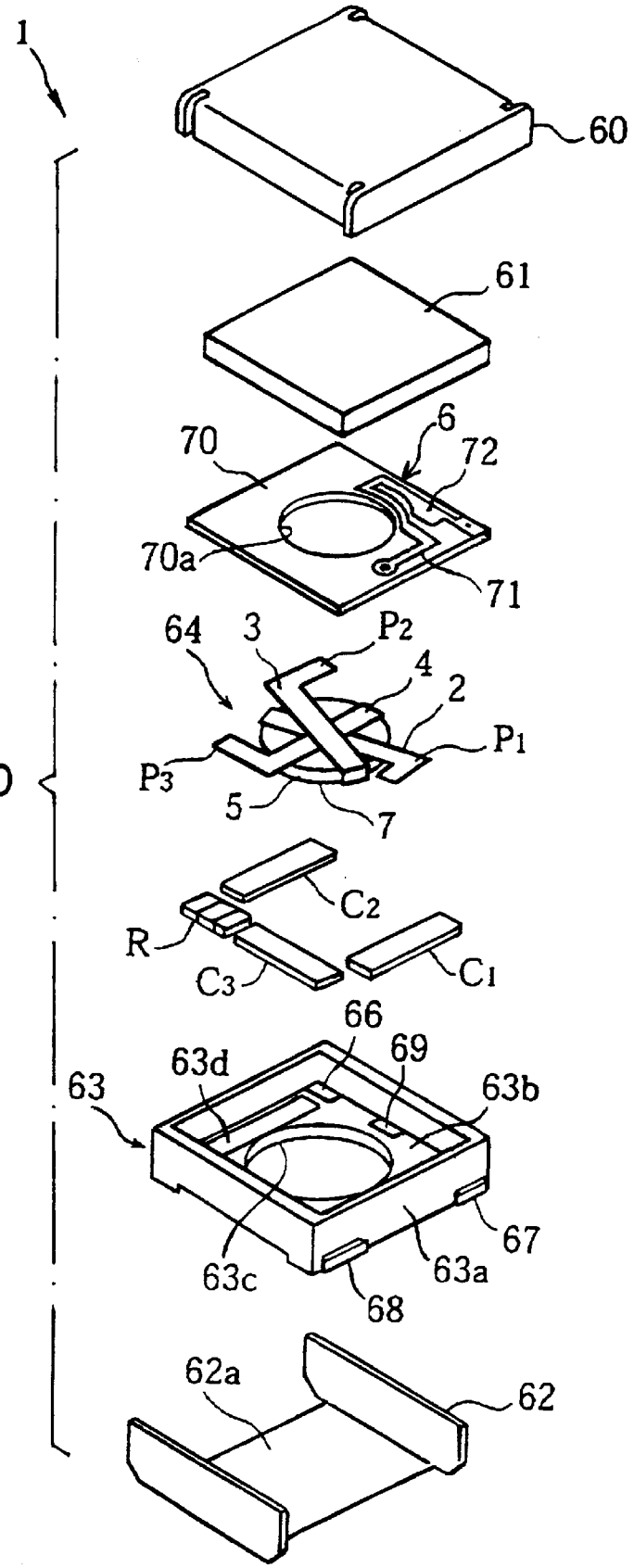
FIG. 10 is an exploded perspective drawing of a lumped-constant isolator according to a sixth embodiment of the invention.
Figure 11:
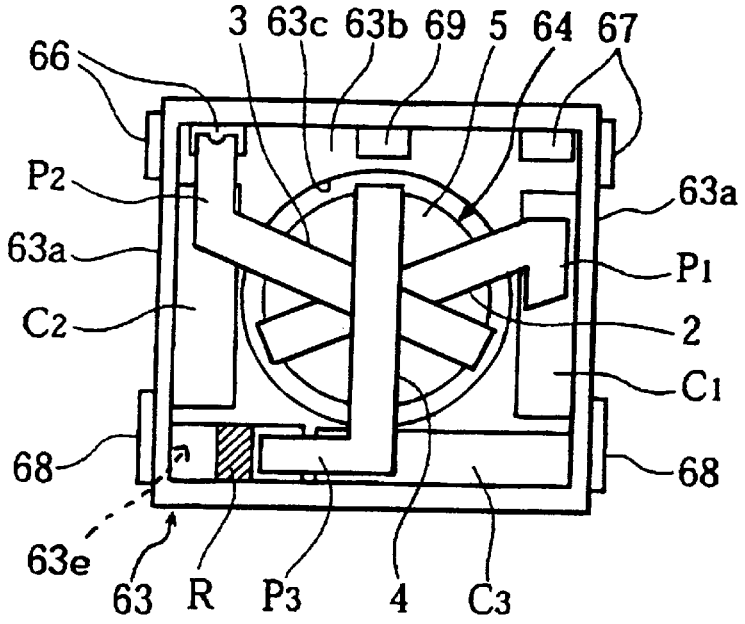
FIG. 11 is a plan view of the resin case of the isolator of FIG. 10.

FIGS. 6 and 7 are a schematic block diagram and a partially exploded perspective view, respectively, for the purpose of explaining a composite electronic component according to a fifth embodiment of the present invention, and symbols identical to those in FIGS. 1 and 2 designate identical or equivalent elements.

In this embodiment, isolator 1 is integrally incorporated within transmitting power amplifier 50, which operates on a power supply voltage of 6V or less. In isolator 1, impedance conversion circuit 6 is added to port P1. The fundamental structure is similar to that in the above-described embodiments.

In transmitting power amplifier 50, the above-described matching circuit 12, first-stage amplifier device 13, interstage matching circuit 14, second-stage amplifier device 15 and output matching circuit 16 are mounted on circuit board 51, devices 12 through 16 being connected to each other by microstrip lines. The output of output matching circuit 16 is connected to isolator 1.

Circuit board 51 is housed in a shield case 52, and leads 53 for surface attachment of the inputs, outputs and ground protrude from between case 52 and circuit board 51.

Since in this embodiment isolator 1 is integrally incorporated within transmitting power amplifier 50 to form a single composite electronic component, its circuit structure can be simplified, and its size reduced, thereby contributing to a reduction in the size of the portable telephone set.

In recent years, with reductions in the size and weight of portable telephone sets, progress has been made in making circuit boards thinner, and in response the width of microstrip lines has been greatly reduced. For example, the width of lines with a characteristic impedance of 50 ohms is 0.5 mm for a board 0.3 mm thick, but is reduced to 0.17 mm for a circuit board 0.1 mm thick.

With such reduced line width it becomes impossible to obtain line width accuracy and mis-matching may occur. And since the solder-mounting pads must be wider than the lines, the problem of mismatching at these mounting pads arises. What is more, thinner lines mean a commensurate increase in transmission loss.

To cope with this, when the characteristic impedance is set at 2 to 12.5 ohms, as in this embodiment, the line width of the microstrip line can be increased in spite of the reduced thickness of circuit board 51, thereby overcoming the above-described problems of mismatching and transmission loss. Even when the width of mounting pads 55 is increased, it is possible to avoid the occurrence of mismatching, thereby preventing contact faults and other degradations in mounting performance due to mis-positioning of isolator 1 during mounting, and improving connection strength.

By these means it is possible to improve the productivity and robustness of equipment for telecommunications, etc., and, in so doing, to provide telecommunications equipment that is economical in price and high in reliability. This is not limited to microstrip lines, but applies similarly to strip lines, coplanar lines, graded coplanar lines and other line configurations.

Further, signals having a characteristic impedance other than 50 ohms pass through a node disposed between output matching circuit 16 and impedance conversion circuit 6. Since the isolator 1 is integrally incorporated in power amplifier 50, that node is also integrally incorporated in power amplifier 50. Thus, the user does not need to handle non-50-ohm systems directly, which facilitates the design of the circuit by the user, since no time need be expended in design changes, etc., to deal with non-50-ohm signals.

FIGS. 10 through 14 are drawings for the purpose of explaining a nonreciprocal circuit device according to a sixth embodiment of the present invention. In this embodiment is described the detailed structure of the isolator incorporating the above-described impedance conversion circuit. Symbols identical to those in FIG. 1 designate identical or equivalent elements.

In these drawings, a reference numeral 1 designates a lumped-constant isolator that is connected to the transmitting power amplifier of a mobile telecommunications set, and has a structure wherein a rectangular permanent magnet 61 is affixed to the inner surface of a box-shaped upper yoke 60 made of a magnetic metal; a lower yoke 62 of the same magnetic metal is attached to upper yoke 60; above the bottom surface 62*a* of lower yoke 62 is disposed a resin case 63; and a magnetic assembly 64 is disposed in resin case 63 in such a manner that a DC magnetic field is applied by permanent magnet 61 to magnetic assembly 64.

Magnetic assembly 64 has a structure wherein three center electrodes 2, 3 and 4 are bent and disposed on the top surface of circular plate-shaped ferrite 5 and separated from each other by interposed insulating sheets (not shown) in such a way as to intersect at an angle of 120 degrees. Input/output ports P1, P2 and P3, which lie at first ends of center electrodes 2 through 4, respectively, protrude outward and grounding portions 7, which lie at the second ends, are attached adjacent to the non-conductive bottom surface of ferrite 5.

Resin case 63 is formed of electrically insulating members, having a structure wherein side panels 63*a* of the rectangular frame are formed integrally with bottom panel 63*b*. A through-hole 63*c* is formed in bottom panel 63*b*, and depressions 63*d* are formed on the periphery of through-hole 63*c* in bottom panel 63*b* for the positioning and accommodation of single-sheet matching capacitors C1 through C3. Also formed is a depression 63*e* for the positioning and accommodation of single-sheet terminal resistor R. Magnetic assembly 64 is inserted into through-hole 63*a,* and grounding portion 7 of magnetic assembly 64 is connected to bottom surface 62*a* of lower yoke 62.

At respective lower corners of the outer surfaces of the left and right side panels 63*a* of resin case 63 are disposed input/output terminals 66 and 67, and the extended tips thereof are exposed at the left and right corners of the upper surface of bottom panel 63*b*. At the lower corners of the outer surfaces of left and right side panels 63*a* of resin case 63 are disposed ground terminals 68, and the extended tips of ground terminals 68 are exposed at the upper surface of depressions 63*d* and 63*e* and are connected to the electrodes on the lower surface of capacitors C1 through C3 and terminal resistor R. Further, a metal conducting piece 69, the extended tip of which is exposed at bottom panel 63*b* and is connected to bottom surface 62*a* of lower yoke 62, is disposed at a point intermediate between input/output terminals 66 and 67 on bottom panel 63*b*. Input/output terminals 66 and 67, ground terminal 68 and metal conducting piece 67 are partially insert-molded within resin case 63.

The electrodes on the upper surfaces of matching capacitors C1 through C3 are connected, respectively, to ports P1 through P3 of center electrodes 2 through 4; the tip of port P2 is connected to input/output terminal 66; and the tip of port P3 is connected to terminal resistor R.

Between magnetic assembly 64 and permanent magnet 61 is disposed a rectangular plate-shaped spacer member 70, which is a printed circuit board which may be made of a glass-epoxy, plastic, Teflon or other material, or a ceramic substrate, or a liquid-crystal polymer which has elasticity, or another resin. In the center of spacer member 70 is formed a hole 70*a*. The purpose of spacer member 70 is to apply pressure effectively to matching capacitors C1 through C3 and center electrodes 2 through 4. Thus, it is unnecessary that the hole 70*a* be formed.

As upper yoke 60 is engaged into lower yoke 62, permanent magnet 61 applies pressure through spacer member 70 to immobilize, electrically and mechanically, magnetic assembly 64 and resin case 63 against lower yoke 62; ports P1 through P3 of center electrodes 2 through 4 against matching capacitors C1 through C3 and terminal resistor R; and matching capacitors C1 through C3 and terminal resistor R against resin case 63, respectively. This eliminates the need for specialized tools to solder the various components together and reduces the number of process steps, and also prevents open faults when users perform surface mounting by reflow soldering.

Figure 12A:
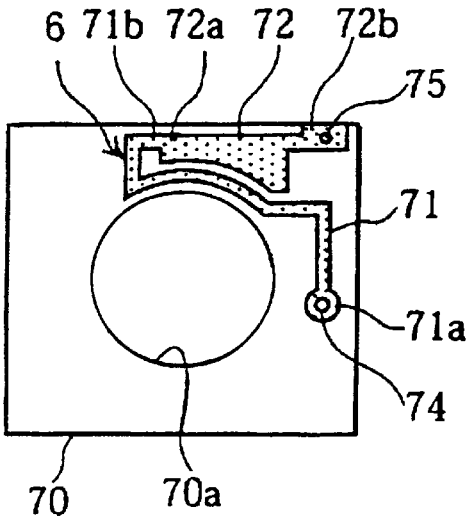
FIGS. 12A and 12B are front and back plan views of the spacer member in the isolator of FIG. 10.
Figure 12B:
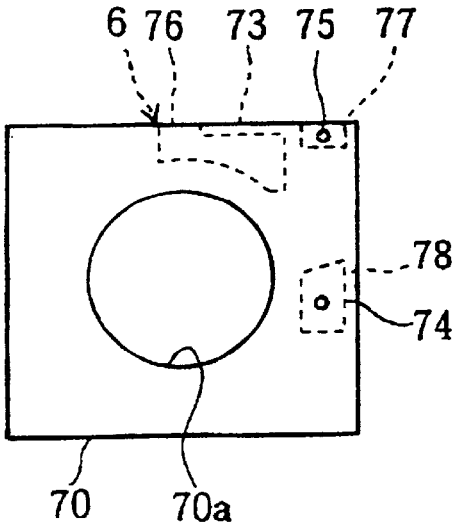

Formed within spacer member 70, as shown in FIGS. 12A and 12B, is an impedance conversion circuit 6, which comprises a C-L-C pi-type network in this embodiment, wherein inductance electrode 71 and first and second capacitor electrodes 72 and 73 are formed by crimping, printing or the like. Electrodes 71 through 73 may also be formed by insert-molding of metal conductor pieces within spacer member 70. FIG. 12A is a plan view showing the electrodes formed on the upper surface of spacer member 70, and FIG. 12B is a plan view showing in phantom the electrodes formed on the lower surface of spacer member 70.

One end 71*a* of inductance electrode 71 is connected to through-hole electrode 74, and the other end 71*b* is connected to one end 72*a* of first capacitor electrode 72. The other end 72*b* of first capacitor electrode 72 is connected to through-hole electrode 75.

Second capacitor electrode 73 is disposed facing first capacitor electrode 72 on the lower surface of spacer member 70, sandwiching spacer member 70. A first connecting electrode 76 is formed in series with second capacitor electrode 73, facing the connection between the other end 71*b* of inductance electrode 71 and the end 72*a* of first capacitor electrode 72.

Further, a second connecting electrode 77 is formed on the portion facing the other end 72*b* of first capacitor electrode 72 on the lower surface of spacer member 70 and the two electrodes 72*b* and 77 are connected by means of through-hole electrode 75. A third connecting electrode 78 is also formed on the portion facing end 71*a* of inductance electrode 71 on the lower surface of spacer member 70, and the two electrodes 71*a* and 78 are connected by means of through-hole electrode 74.

First connecting electrode 76 is connected to lower yoke 62 across interposed metal conducting piece 69, second connecting electrode 77 is connected to input/output terminal 67 on the other side, and third connecting electrode 78 is connected to port P1 of center electrode 2 and to the electrode on the upper surface of capacitor C1.

Figure 13:
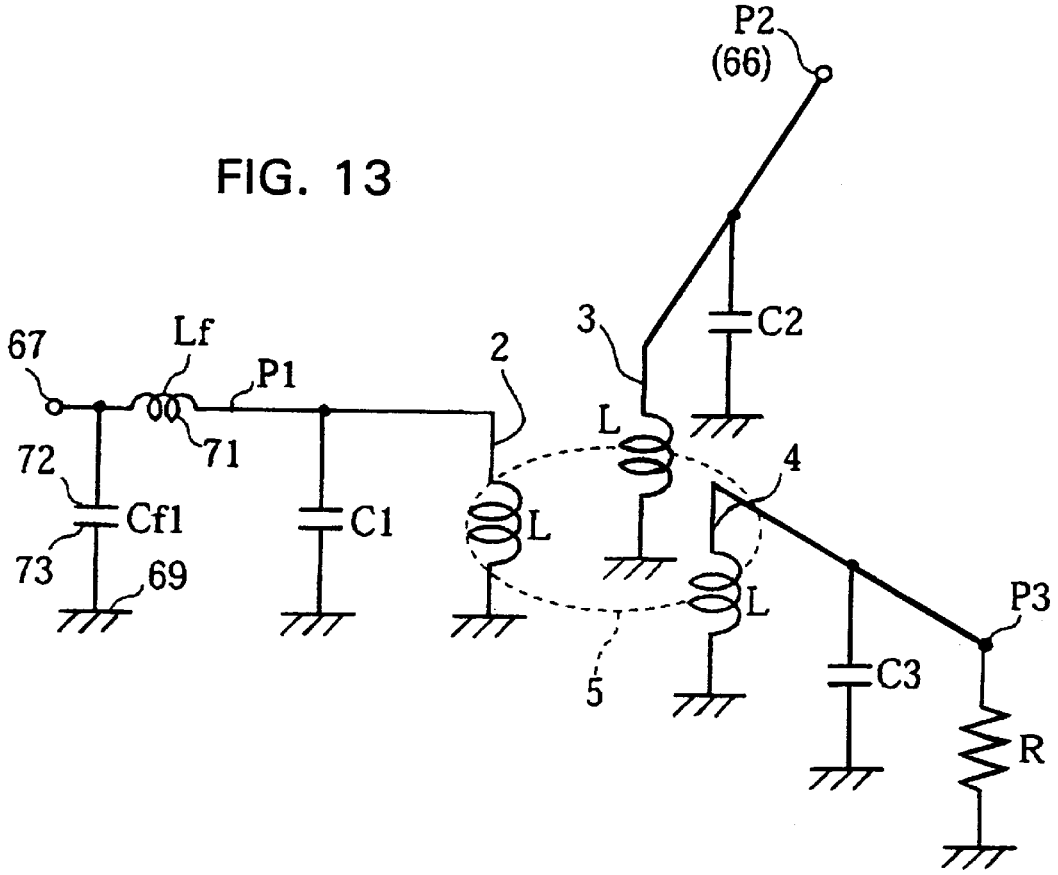
FIG. 13 is an equivalent circuit diagram of the isolator of FIG. 10.
Figure 14:
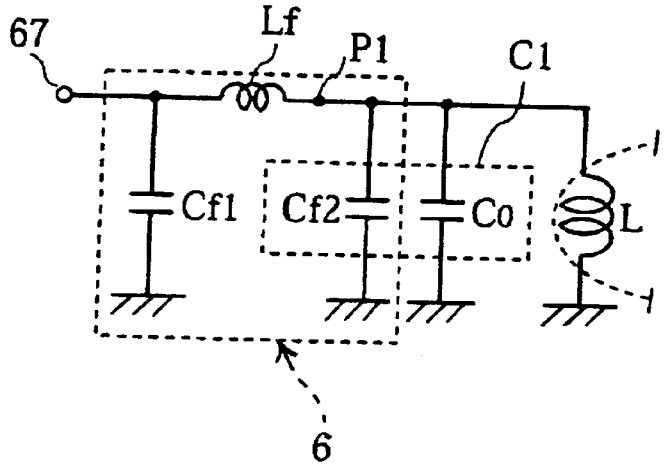
FIG. 14 is a circuit diagram of the low-pass filter in the isolator of FIG. 10.

In this way, in isolator 1 according to this embodiment, as shown in the equivalent circuits in FIGS. 13 and 14, inductance Lf formed by inductance electrode 71 is connected in series between port P1 of center electrode 2 and input/output terminal 67, and capacitor Cf1 formed by first and second capacitor electrodes 72 and 73 is connected between input/output terminal 67 and metal conducting piece 69 (ground).

Thus matching capacitor C1 of port P1 may be considered to comprise a parallel capacitance including capacitor Co, which is the conventional capacitance in the matching circuit of the isolator, and a capacitor Cf2, so that a C-L-C impedance conversion circuit 6 is configured from capacitor Cf2, inductance Lf and capacitor Cf1.

According to this embodiment, since impedance conversion circuit 6 is added to port P1 and the impedance is set at 2 to 12.5 ohms, a low impedance can, as described above, be converted into a stable impedance, thereby making it possible to reduce insertion loss when operating with a low power supply voltage, to broaden the frequency band, and to achieve effects similar to those obtained with the embodiments above described.

Since impedance conversion circuit 6 is formed on spacer member 70, which is a component of isolator 1, impedance conversion circuit 6 can be formed integrally within isolator 1, thereby avoiding the increased cost of components and greater bulk that would ensue if the conversion circuit were provided separately, and contributing to reductions in the size and price of the mobile communications equipment. Further, because effective use is made of spacer member 70 in the formation of the isolator, there is no increase in the dimensions of the isolator, making a further contribution to reduced size and lighter weight.

Note that in the embodiments described above, examples are adduced in which the impedance conversion circuit is formed on the spacer member, but the present invention is not thus limited, and the impedance conversion circuit may equally be formed on another circuit board or component used to configure a nonreciprocal circuit disposed within the yoke.

As can be seen from the above, by means of a nonreciprocal circuit device as disclosed herein, the input/output impedance Zio of the port of one of the center electrodes is set at $2<Zio<12.5$ ohms, so that it is possible to convert a low impedance into a stable impedance, eliminating the need for a matching circuit having a large impedance conversion factor and thereby avoiding an increase in the insertion loss when power supply voltage is low, and broadening the frequency bandwidth, improving reliability with respect to quality. In order to set the input impedance Zi of the port at 2<Zi<12.5 ohms, an impedance conversion circuit is added to the port of any one of the center electrodes accomplishing the conversion to stable impedance.

A terminal resistor may be connected to one of the remaining ports to which the impedance conversion circuit is not added, so that the nonreciprocal circuit element functions as an isolator.

The impedance conversion circuit may be configured as a C-L-C pi-type network.

The cut-off frequency fc of the C-L-C pi-type network may be set in the range 0.75×fo<fc<2×fo, so that it functions as a low-pass filter, suppressing and eliminating the spurious radio waves generated by the transmitting power amplifier, and thereby achieving the effect of contributing to improved reliability and higher performance.

The impedance conversion circuit may also be configured as an L-C-L pi-type network.

In a further alternative, the impedance conversion circuit may be configured as a (2n−1)·lambda-g/4 (where n is a natural number and lambda-g is the wavelength in the line) distributed-constant transformer.

The impedance conversion circuit can be integrally incorporated within the yoke, so that an increase in cost and size associated with the use of a separate circuit is avoided. The impedance conversion circuit can be formed in a component of the nonreciprocal circuit disposed within the yoke so that this component is utilized structurally as well as electrically, thereby contributing to size and weight reduction.

The nonreciprocal circuit device can be integrally incorporated within a transmitting amplifier that operates at a power supply voltage of 6 V or less, thereby contributing to the simplification of the circuit structure, with the effect of contributing to size reduction, and allowing line width to be increased with the further effect of preventing the occurrence of mis-matching.

Although the present invention has been described in relation to particular embodiments thereof, many other variations and modifications and other uses will become apparent to those skilled in the art. Therefore, the present invention is not limited by the specific disclosure herein.

What is claimed is:

1. A nonreciprocal circuit device comprising:

a plurality of center electrodes so disposed as to intersect; and a ferrite disposed adjacent to the point of said intersection, said ferrite being adapted for receiving a DC magnetic field;

each of said center electrodes having an end which defines a port, wherein an input/output impedance Zio of the port of one of said center electrodes is set at 2<Zio<12.5 ohms.

2. A nonreciprocal circuit device comprising a plurality of center electrodes so disposed as to intersect;

a ferrite disposed adjacent to the point of said intersection, said ferrite being adapted for receiving a DC magnetic field;

each of said center electrodes having an end which defines a port; and an impedance conversion circuit being connected to the port of one of said center electrodes such that the input impedance Zi of said port is set at 2<Zi<12.5 ohms.

3. A nonreciprocal circuit device according to claim 2, wherein a terminal resistor is connected to one of the remaining ports other than the port to which said impedance conversion circuit is connected, forming an isolator.

4. A nonreciprocal circuit device according to claim 2 or claim 3, wherein said impedance conversion circuit is configured as a C-L-C pi-type network.

5. A nonreciprocal circuit device according to claim 4, wherein said C-L-C pi-type network has a cut-off frequency fc which is set at 0.75×fo<fc<2×fo.

6. A nonreciprocal circuit device according to claim 2 or 3, wherein said impedance conversion circuit is configured as an L-C-L pi-type network.

7. A nonreciprocal circuit device according to claim 2 or 3, wherein said impedance conversion circuit is configured as a (2n−1)·lambda-g/4 distributed-constant transformer, where n is a natural number and lambda-g is the wavelength of a line therein.

8. A nonreciprocal circuit device comprising:

a plurality of center electrodes so disposed as to intersect with each other;

a magnetic assembly comprising a ferrite disposed adjacent to the point of said intersection, said ferrite being adapted to receive a DC magnetic field;

a yoke constituting a magnetic circuit for said DC magnetic field, said point of intersection being within said yoke;

each of said center electrodes having an end which defines a port, matching capacitors being connected respectively to the ports of said center electrodes; and an impedance conversion circuit is connected to the port of one of said center electrodes and integrally incorporated within said yoke, whereby an input impedance Zi of said port is set at 2<Zi<12.5 ohms.

9. A nonreciprocal circuit device according to claim 8, wherein said impedance conversion circuit is formed in a structural component of said nonreciprocal circuit, said structural component being disposed within said yoke.

10. A composite electronic component comprising:

a transmitting amplifier which operates at a power supply voltage of 6 V or less; and a nonreciprocal circuit device according to any of claims 1, 2 and 8;

said nonreciprocal circuit device being connected to the output of said transmitting amplifier;

said nonreciprocal circuit device and said transmitting amplifier being accommodated within a single case, said case being provided with terminals disposed in a plane for surface mounting on a circuit board.

* * * * *